US006218993B1

(12) United States Patent
Chao et al.

(10) Patent No.: US 6,218,993 B1
(45) Date of Patent: Apr. 17, 2001

(54) STRETCHABLE ANTENNA FOR MOBILE PHONES

(75) Inventors: Jack Chao, Pa-Te; Annie Yang, Tao-Yuan, both of (TW)

(73) Assignee: Auden Technology Mfg. Co. Ltd., Tao-Yuan Hsien (TW)

( * ) Notice: Subject to any disclaimer, the term of this patent is extended or adjusted under 35 U.S.C. 154(b) by 0 days.

(21) Appl. No.: 09/559,589

(22) Filed: Apr. 28, 2000

(51) Int. Cl.[7] ..... H01Q 1/26
(52) U.S. Cl. ..... 343/702; 343/895
(58) Field of Search ..... 343/702, 725, 343/730, 752, 729, 715, 850, 895, 900, 901, 906

(56) References Cited

U.S. PATENT DOCUMENTS 5,686,927 * 11/1997 Simmons ..... 343/702
5,717,409 * 2/1998 Garner et al. ..... 343/702
5,945,953 * 8/1999 Tsuda et al. ..... 343/702
6,075,489 * 6/2000 Sullivan ..... 343/702

* cited by examiner

*Primary Examiner*—Don Wong
*Assistant Examiner*—Chuc D Tran
(74) *Attorney, Agent, or Firm*—Dougherty & Troxell

(57) ABSTRACT

A gain structure of a stretchable antenna for mobile phones and especially of an antenna for minimized mobile phones, wherein, a quarter-wave coil antenna is built in a hole of a connecting member on the top of a mobile phone, one end of the coil antenna is pressed against a metallic conductive block in the connecting member; a spring sheet has its top folded end fixed on the metallic conductive block, and has the other end thereof extended in a hole provided on the top of the mobile phone to abut on an internal electric circuit board under a pressing force. A quarter-wave rod antenna is connected to the connecting member to be freely movable in and out of it. When the rod antenna is stretched out, a metallic bottom end sleeve thereof is pressed into the metallic conductive block to make electric connection therewith, this can increase gain in signal receiving and emitting of the minimized mobile phone.

4 Claims, 4 Drawing Sheets

STRETCHABLE ANTENNA FOR MOBILE PHONES

BACKGROUND OF THE INVENTION

1. Field of the Invention

The present invention is related to a gain structure of a stretchable antenna for mobile phones, and especially to a gain structure of a stretchable rod antenna capable of increasing capability of signal receiving and emitting in cooperation with a coil antenna when the rod antenna is stretched.

2. Description of the Prior Art

A conventional antenna for mobile phones is divided mainly into two kinds; they are the quarter-wave and the half-wave antennas. The quarter-wave antennas have lower impedance in servo linking, and do not need using of impedance transformers, but they are inferior to the half-wave antennas in the capability of signal receiving and emitting. The half-wave antennas have higher impedance, and need using of impedance transformers in the interior of their mobile phones.

In the recent years, mobile phones tend to be minimized. Half-wave antennas have higher impedance and need impedance transformers which occupy larger space in their mobile phones; other redundant parts used further increase their costs. Lengths of half-wave antennas generally are hard to suit modern pocket mobile phones; such lengths are disproportional to the main bodies after assembling. In view of this, pocket mobile phones generally use quarter-wave antennas or quarter-wave coil antenna; however, quarter-wave antennas are evidently insufficient in the capability of signal receiving and emitting even when the rods of antennas as radiators are fully stretched.

In a U.S. patent "Antenna device for portable equipment" U.S. Pat. No. 5,757,325 granted to Saldell, an impedance transformer is evidently used.

In another U.S. Pat. No. 5,661,495 granted to Saldell, a technique is disclosed to use a switching device to separate a quarter-wave antenna when the antenna is retracted; however, it is still insufficient in the capability of signal receiving and emitting.

In another U.S. Pat. No. 5,771,023, a coil antenna for broad bands is disclosed, wherein, a broadband antenna is formed by connecting two coil antennas respectively with a rod antenna.

A U.S. Pat. No. 5,650,789 provides a retractable antenna for an indoor wireless telephone set, of which two coil antennas are respectively used at the end of a rod antenna and the telephone set. The coil antenna at the end of the rod antenna is electrically broken when the latter is stretched out, but can make a fixed coil antenna on the surface of an engaging seat form electromagnetic coupling with the coil antenna at the end of the rod antenna for signal receiving and emitting when the rod antenna is retracted. This patent still cannot increase capability of signal receiving and emitting by using a quarter-wave antenna.

SUMMARY OF THE INVENTION

The object of the present invention is to provide a gain structure of a stretchable antenna for mobile phones, wherein, a coil antenna is provided in a connecting member on the telephone set. The coil antenna is connected with a metallic conductive block normally. A spring sheet is connected on an end thereof with the metallic conductive block, while the other end thereof contacts the electric circuit board in the telephone set. A rod antenna which can be stretched and contracted and is provided with a metallic bottom end sleeve is not electrically connected when it is contracted, and has the metallic bottom end sleeve connected to the metallic conductive block to get gain in capability of signal receiving and emitting when it is stretched. The above stated structure of antenna can thus suit a quarter-wave coil antenna and a quarter-wave rod antenna on a miniature mobile phone.

The present invention will be apparent in its novelty and features after reading the detailed description of the preferred embodiment thereof in reference to the accompanying drawings.

DETAILED DESCRIPTION OF THE PREFERRED EMBODIMENT

Figure 1:
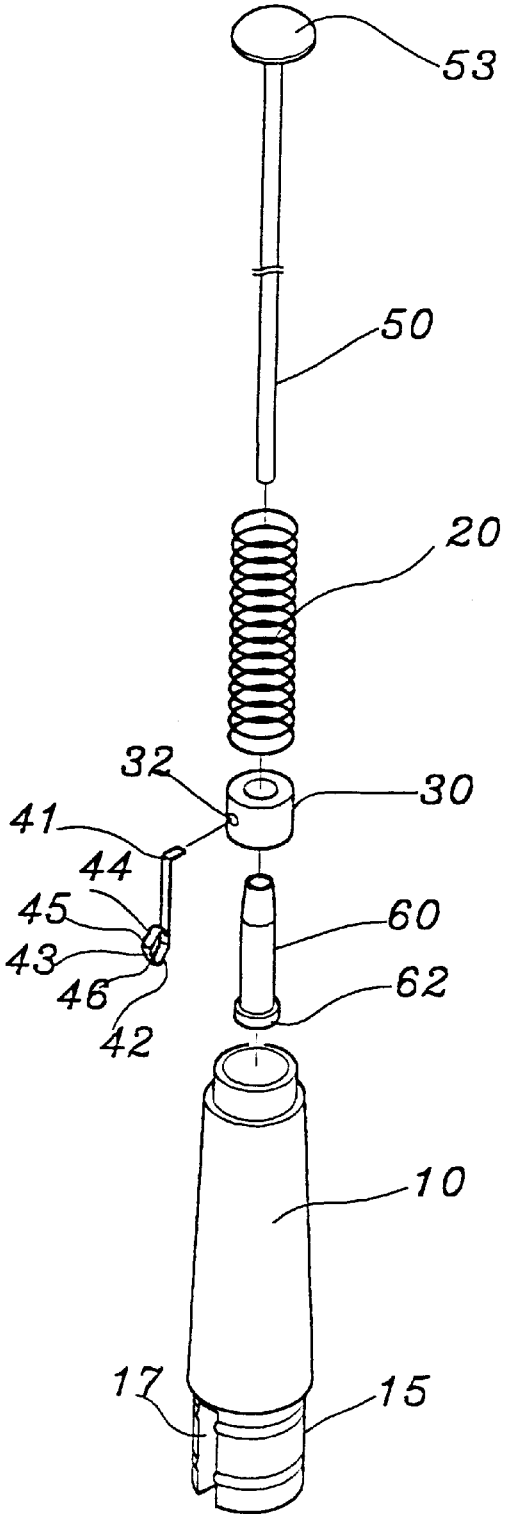
FIG. 1 is an analytic perspective view showing the elements of a preferred embodiment of the present invention.
Figure 2:
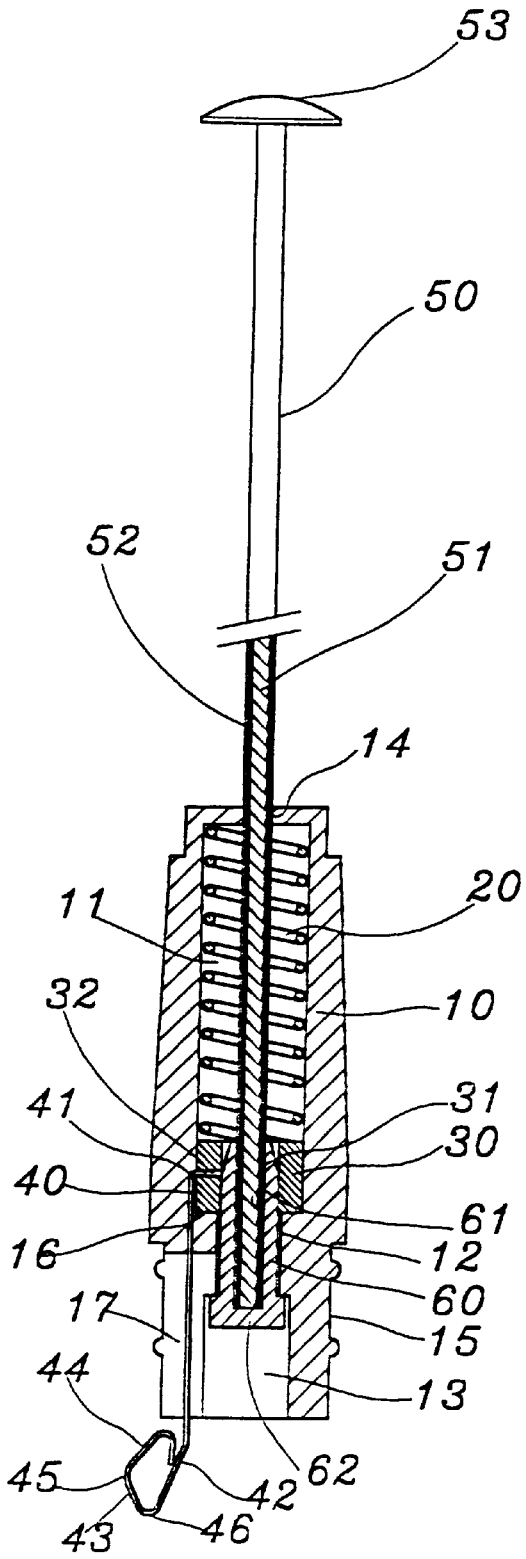
FIG. 2 is a sectional view showing the embodiment of FIG. 1 after assembling.

Referring to FIGS. 1 and 2, the present invention is provided generally with a connecting member 10 connectable to a mobile phone. The connecting member 10 normally is formed from non-electrically conductive material and is provided with a first inner bore 11 of suitable size smaller than the diameter of a second connecting inner bore 12 and a third inner bore 13 (opened downwardly) of the connecting member 10. Diameter of the third inner bore 13 is slightly larger than that of the second connecting inner bore 12. A through hole 14 is provided on the top surface of the connecting member 10 in communication with the first inner bore 11, the diameter of the through hole 14 is slightly larger than that of a rod antenna. The lower section of the whole connecting member 10 is provided with a connecting portion 15.

The first inner bore 11 stated above can accept insertion of a coil antenna 20 which is a quarter-wave antenna for suiting a miniature mobile phone. A metallic conductive block 30 is mounted at the inner bottom of the first inner bore 11, so that one end of the coil antenna 20 is abutted on the inner top surface of the first inner bore 11; while the other end thereof is abutted on the upper surface of the metallic conductive block 30. The metallic conductive block 30 is provided with a central hole 31 with a diameter larger than that of the rod antenna and is provided with a radial hole 32.

Figure 3:
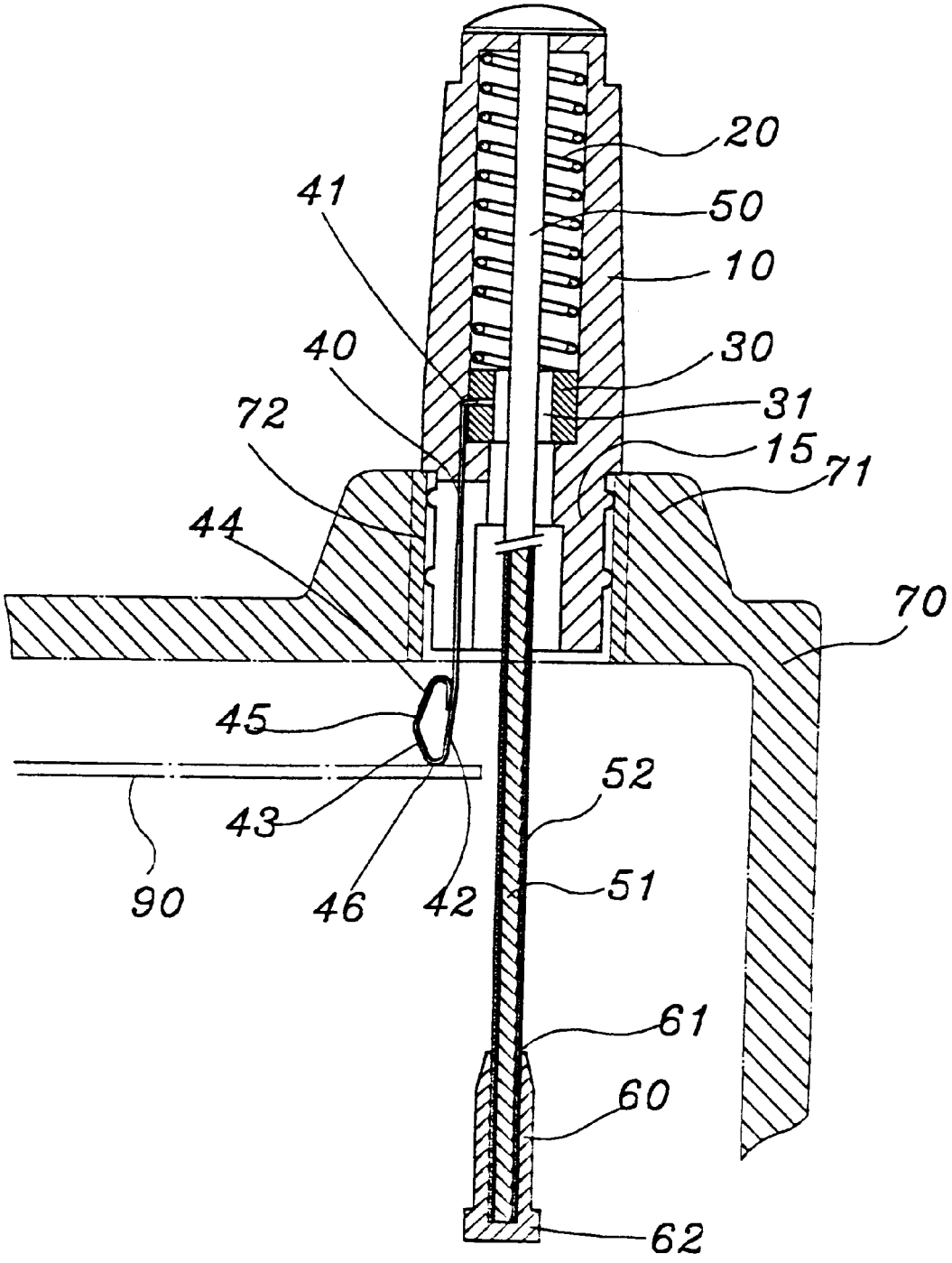
FIG. 3 is a sectional view showing retracting state of the rod antenna of the embodiment of FIG. 2.
Figure 4:
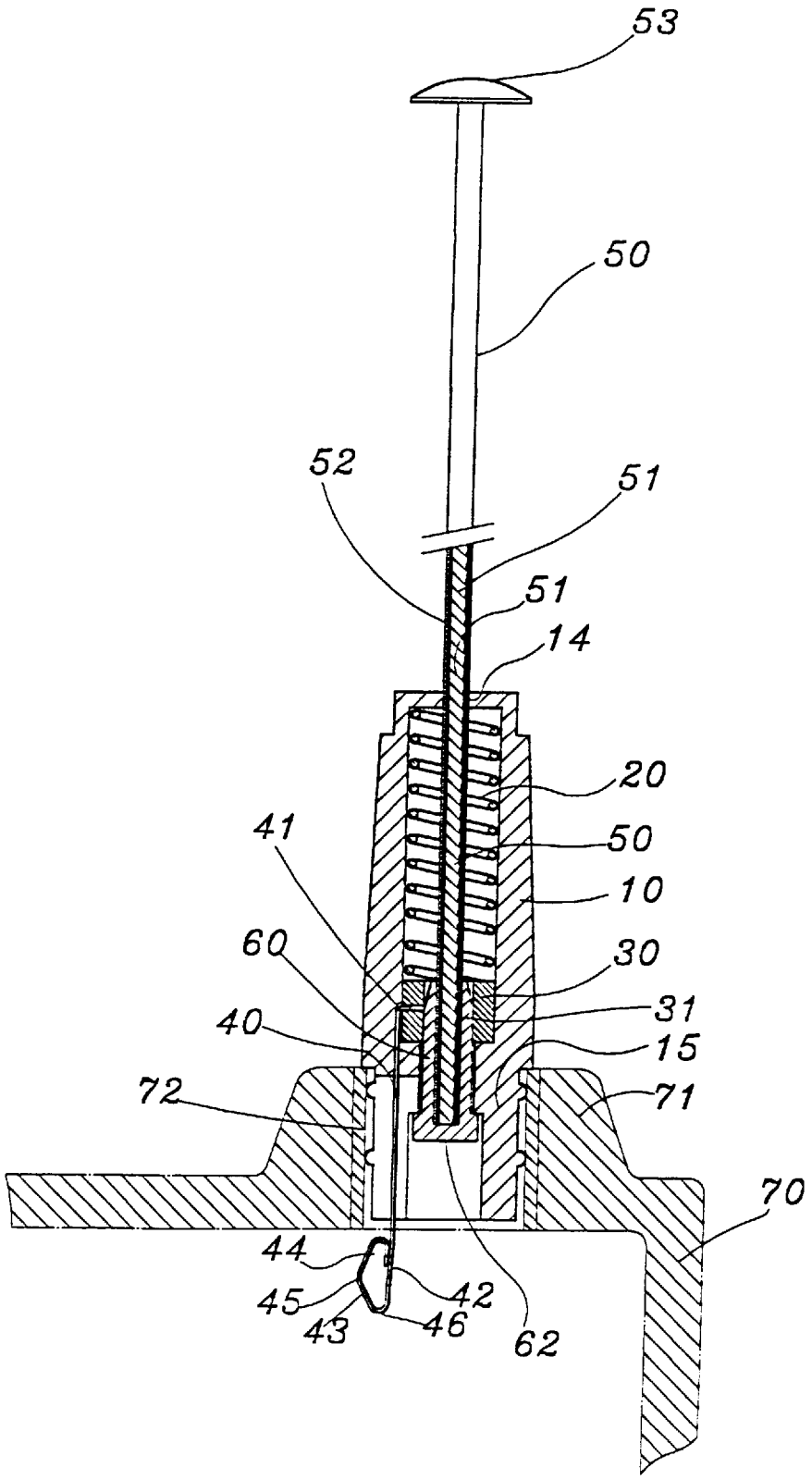
FIG. 4 is a sectional view showing stretching state of the rod antenna of the embodiment of FIG. 2.

A spring sheet 40 has its top folded end 41 inserted into the radial hole 32 of the metallic conductive block 30, and has the other end thereof extended for a suitable length to abut on the internal electric circuit board 90 (FIGS. 3 and 4). A hole 16 and a slit 17 are provided for extending of the spring sheet 40 therethrough respectively on the connecting member 10 between the first inner bore 11 and the second connecting inner bore 12 as well as on the connecting portion 15 of the connecting member 10.

The coil antenna 20, the metallic conductive block 30 and the spring sheet 40 in the assembled gain structure can have the connecting portion 15 forcedly connected in a hole in a connecting seat 71 provided on the top of the mobile phone 70 as shown in FIGS. 3 and 4. The hole is provided therein with an insulation lining 72 to be tightly connected with the connecting portion 15 of the connecting member 10.

In order to make sure of the contact of the spring sheet 40 with the internal electric circuit board 90, in the preferred embodiment, the bottom end of the spring sheet 40 is folded into a beveled section 42, and then is folded from this section 42 into an even more beveled shorter section 43, another section 44 folded back to the beveled section 42 is formed on the end of the shorter section 43. Thereby, the shorter section 43 and the folded back section 44 form therebetween a pressing point 45 which protrudes out of the connecting portion 15 of the connecting member 10 and has a specific distance from the vertical main body of the spring sheet 40 for elastic stretching. Thereby, when the connecting member 10 is inserted into the insulation lining 72 in the connecting seat 71 of the mobile phone 70, the pressing point 45 of the whole spring sheet 40 will be pressed by the fact that it is the most protruding end. Hence the spring sheet 40 is moved rightwards as of FIGS. 3 and 4 under pressing force about the top folded end 41 until the bottommost point 46 formed between the beveled section 42 and the shorter section 43 contacts the internal electric circuit board 90. In this mode of connection, the pressing point 45 of the whole spring sheet 40 is forced to abut against the insulation lining 72, and the bottommost point 46 under a slight down pressing force assures contact with the internal electric circuit board 90.

A quarter-wave rod antenna 50 can be mounted in the above stated connecting member 10 of a minimized mobile phone, as a normal antenna, it can be enveloped by injection molding by an insulation coating 52 over the nickel-chromium wire 51 thereof, and is provided with a top cap 53. The rod antenna 50 of the present invention is slipped over by a metallic bottom end sleeve 60 provided with a central hole 61 for insertion of a partial section of the rod antenna 50. The metallic bottom end sleeve 60 fits the central hole 31 of the metallic conductive block 30 and the second connecting inner bore 12. The metallic bottom end sleeve 60 is further provided with a bottom 62 fitting the third inner bore 13. The shank of the whole rod antenna 50 can thereby freely stretch and contract in the topmost through hole 14 and other related internal holes.

Referring to FIG. 3, when the rod antenna 50 is retracted, the whole rod antenna 50 is not electrically connected by virtue that it does not contact with any connecting member. At this time, the mobile phone 70 does signal receiving and transmitting through the coil antenna 20 having been electrically connected. When the rod antenna 50 is in the state as shown in FIG. 4, the metallic bottom end sleeve 60 thereof is pressed into the central hole 31 of the metallic conductive block 30 to make electric connection therewith to get the gain of ¼+¼ wavelengths in signal receiving and transmitting.

The mobile phone 70 can thus suit the minimized quarter-wave coil antenna plus quarter-wave rod antenna. When the rod antenna 50 is stretched out, a gain of half-wavelength can be obtained, so that the minimized mobile phone 70 can have strengthened capability of signal receiving and emitting.

Having thus described the technical structure of my invention with novelty, practicability and industrial utility, therefore, what I claim as new and desire to be secured by Letters Patent of the United States are:

1. A gain structure of a stretchable antenna for mobile phones comprising:

an insulating connecting member connected with an insulation lining in a hole provided on the top of said mobile phone, said connecting member is provided with a first inner bore, a second connecting inner bore communicating with said first inner bore, and a third inner bore opened downwardly and communicated with said second connecting inner bore;

a coil antenna provided in said first inner bore;

a metallic conductive block mounted at the inner bottom of said first inner bore, one end of said coil antenna is abutted on the inner top surface of said first inner bore, while the other end thereof is abutted on the upper surface of said metallic conductive block, said metallic conductive block is provided with a central hole with a diameter larger than that of said rod antenna and is provided with a radial hole;

a spring sheet having a top folded end thereof fixedly inserted into said radial hole of said metallic conductive block, and having the other end thereof extended for a distance, the bottommost point thereof under a pressing force thus abuts on and is electrically connected with an internal electric circuit board of said mobile phone;

a rod antenna mounted in said connecting member freely stretchable and contractible, it is provided with a top cap and a metallic bottom end sleeve, said rod antenna is not electrically connected when it is retracted, when said rod antenna is stretched out, said metallic bottom end sleeve thereof is pressed into a central hole of said metallic conductive block to make electric connection therewith.

2. A gain structure of a stretchable antenna for mobile phones as claimed in claim 1, wherein, said extended other end of said spring sheet protrudes through said connecting member and out of a connecting portion of said connecting member for being pressed for electric connection.

3. A gain structure of a stretchable antenna for mobile phones as claimed in claim 2, wherein, said protruding end of said spring sheet is folded into a beveled section, and then is folded from said beveled section into an even more beveled shorter section, another section folded back to said beveled section is formed on the end of said shorter section, said beveled section and said more beveled shorter section form therebetween said bottommost point abutting on said internal electric circuit board, and said shorter section and said folded back section form therebetween a protruding pressing point.

4. A gain structure of a stretchable antenna for mobile phones as claimed in claim 2, wherein, said protruding pressing point is forced to abut against said insulation lining when said connecting portion of said connecting member is inserted into said hole on the top of said mobile phone.

* * * * *